US010378499B2

(12) United States Patent
Carlson

(10) Patent No.: US 10,378,499 B2
(45) Date of Patent: Aug. 13, 2019

(54) COMMON RAIL ACCUMULATOR CLAMP

(71) Applicant: Caterpillar Inc., Peoria, IL (US)

(72) Inventor: Joshua David Carlson, Peoria, IL (US)

(73) Assignee: Caterpillar Inc., Deerfield, IL (US)

( * ) Notice: Subject to any disclaimer, the term of this patent is extended or adjusted under 35 U.S.C. 154(b) by 132 days.

(21) Appl. No.: 15/374,092

(22) Filed: Dec. 9, 2016

(65) Prior Publication Data

US 2018/0163684 A1 Jun. 14, 2018

(51) Int. Cl.
*F02M 61/14* (2006.01)
*F02M 63/00* (2006.01)

(52) U.S. Cl.
CPC ..... *F02M 61/14* (2013.01); *F02M 63/0003* (2013.01); *F02M 2200/855* (2013.01)

(58) Field of Classification Search
CPC ..... F02M 61/14; F02M 2200/855; F02M 63/0003
See application file for complete search history.

(56) References Cited

U.S. PATENT DOCUMENTS 1,793,234 A * 2/1931 Mahler ..... F02M 61/14 123/468
2,790,462 A 4/1957 Ashton
2,795,932 A 6/1957 McLuen
4,901,700 A * 2/1990 Knight ..... F02M 61/14 123/470
5,421,550 A 6/1995 Palmer
5,566,658 A 10/1996 Edwards et al.
6,745,752 B1 6/2004 Jensen et al.
8,522,754 B2 * 9/2013 Lazich ..... F02M 61/14 123/470
2009/0241907 A1 10/2009 Kondo et al.
2010/0300408 A1 12/2010 Aronhalt et al.
2017/0130686 A1 * 5/2017 Schultz ..... F02M 55/025

FOREIGN PATENT DOCUMENTS

EP 2428294 A2 3/2012
WO 2010035285 A3 7/2010

OTHER PUBLICATIONS

International Search Report for related International Application No. PCT/US2017/061680; dated Mar. 5, 2018.

* cited by examiner

*Primary Examiner* — Joseph J Dallo
*Assistant Examiner* — Kurt Philip Liethen
(74) *Attorney, Agent, or Firm* — Miller, Matthias & Hull

(57) ABSTRACT

An accumulator clamp for an accumulator assembly in an engine assembly is disclosed. The accumulator assembly further includes an accumulator body and a fuel line adapter connected thereto, and the accumulator assembly is mountable into a cylinder head accumulator bore of a cylinder head. The accumulator clamp includes a clamp body having a clamp accumulator bore receiving an end of the accumulator body, and a bolt bore on either side of the clamp accumulator bore for receiving threaded portions of accumulator mounting bolts that secure the accumulator assembly to the cylinder head. The bolt bores include bolt slots through the walls of the accumulator body so that the threaded portions of the accumulator mounting bolts are insertable into and removable from the bolt bores through the bolt slots to allow installation and removal of the accumulator assembly without disassembling components of the engine assembly around the cylinder head.

20 Claims, 6 Drawing Sheets

COMMON RAIL ACCUMULATOR CLAMP

TECHNICAL FIELD

The present disclosure relates generally to common rail fuel injection systems for engines for machines and vehicles and, more particularly, to a slotted accumulator clamp and accompanying accumulator assembly that can be inserted into and removed from a cylinder head for maintenance or replacement without removing a nearby air intake manifold.

BACKGROUND

Common rail direct fuel injection is a direct fuel injection system for gasoline and diesel engines in various applications, such as in providing power to machines and vehicle. In diesel engines for example, a common rail fuel injection system may feature a high-pressure fuel rail having a plurality of fuel lines each feeding an individual accumulator assembly with a valve to provide the high-pressure fuel to a corresponding fuel injector for one of the combustion cylinders of the engine. FIG. 1 illustrates an example of a known accumulator assembly 10. The accumulator assembly 10 includes an accumulator body 12, a fuel line adapter 14 and an accumulator clamp 16. The accumulator clamp 16 has a central through bore that receives an end of the accumulator body 12, with the fuel line adapter 14 being coupled to the end of the accumulator body 12 inserted into the central through bore. The accumulator clamp 16 further includes side through bores on either side of the central through bore.

The end of the accumulator body 12 opposite the fuel line adapter 14 and the accumulator clamp 16 is inserted into an accumulator bore of a cylinder head where the accumulator body will come into fluid communication with the corresponding fuel injector. A pair of accumulator mounting bolts extending from the cylinder head on either side of the accumulator bore are received by and extend through the side through bores of the accumulator clamp. Spacers 18 as shown may provide additional length to the side through bores where necessary depending on the length of the accumulator mounting bolts, and nuts are applied to the ends of the accumulator mounting bolts to secure the accumulator assembly to the cylinder head.

It is typical that space is limited within the engine compartment of the machine or vehicle in which the common rail fuel injection system is implemented. Consequently, other components of the engine may be mounted in close proximity to the cylinder head and the accumulator bore at which the accumulator assembly is installed. For example, in some engine compartments, an air intake manifold is mounted near the cylinder head. The proximity of the other components, combined with the length of the accumulator mounting bolts, often necessitates removal of the other components to provide clearance for the side through bores to receive or slide off of the accumulator mounting bolts.

SUMMARY OF THE DISCLOSURE

In one aspect of the present disclosure, an accumulator clamp for an accumulator assembly in an engine assembly of a machine is disclosed. The accumulator assembly further includes an accumulator body and a fuel line adapter connected thereto, and the accumulator assembly is mountable to a cylinder head of the engine assembly with an injector end of the accumulator body disposed within a cylinder head accumulator bore of the cylinder head. The accumulator clamp includes a clamp body having a clamp body front surface, a clamp body rear surface, a clamp body bottom surface, a clamp body top surface, a clamp body first side surface and a clamp body second side surface, and a clamp accumulator bore surface defining a clamp accumulator bore extending through the clamp body from a clamp accumulator bore bottom opening in the clamp body bottom surface to a clamp accumulator bore top opening in the clamp body top surface. The clamp accumulator bore is shaped to receive a fuel line adapter connection end of the accumulator body inserted through the clamp accumulator bore bottom opening and through the clamp accumulator bore. The accumulator clamp further includes a first bolt bore surface defining a first bolt bore extending through the clamp body proximate the clamp body first side surface from a first bolt bore bottom opening in the clamp body bottom surface to a first bolt bore top opening in the clamp body top surface. The first bolt bore is shaped to receive a first threaded portion of a first accumulator mounting bolt extending from the cylinder head adjacent the cylinder head accumulator bore, a first bolt bore inner diameter of the first bolt bore is greater than a first thread portion outer diameter of the first threaded portion of the first accumulator mounting bolt, and the first bolt bore surface further defines a first bolt slot through the clamp body from the first bolt bore surface to the clamp body front surface, with the first bolt slot extending upwardly from the clamp body bottom surface and terminating before the first bolt slot extends through the clamp body top surface and with the first bolt slot having a first bolt slot width that is greater than the first thread portion outer diameter of the first threaded portion so that the first threaded portion of the first accumulator mounting bolt is insertable into and removable from the first bolt bore through the first bolt slot. The accumulator clamp also includes a second bolt bore surface defining a second bolt bore extending through the clamp body proximate the clamp body second side surface from a second bolt bore bottom opening in the clamp body bottom surface to a second bolt bore top opening in the clamp body top surface. The second bolt bore is shaped to receive a second threaded portion of a second accumulator mounting bolt extending from the cylinder head adjacent the cylinder head accumulator bore and diametrically opposite from the first accumulator mounting bolt relative the cylinder head accumulator bore, a second bolt bore inner diameter of the second bolt bore is greater than a second thread portion outer diameter of the second threaded portion of the second accumulator mounting bolt, and the second bolt bore surface further defines a second bolt slot through the clamp body from the second bolt bore surface to the clamp body front surface, with the second bolt slot extending upwardly from the clamp body bottom surface and terminating before the second bolt slot extends through the clamp body top surface and with the second bolt slot having a second bolt slot width that is greater than the second thread portion outer diameter of the second threaded portion so that the second threaded portion of the second accumulator mounting bolt is insertable into and removable from the second bolt bore through the second bolt slot.

In another aspect of the present disclosure, an accumulator clamp for an accumulator assembly in an engine assembly of a machine is disclosed. The accumulator assembly further includes an accumulator body and a fuel line adapter connected thereto, and the accumulator assembly is mountable to a cylinder head of the engine assembly with an injector end of the accumulator body disposed within a cylinder head accumulator bore of the cylinder head. The accumulator clamp includes a clamp body having a clamp body front surface, a clamp body rear surface, a clamp body bottom surface, a clamp body top surface, a clamp body first side surface and a clamp body second side surface, and a clamp accumulator bore extending through the clamp body from the clamp body bottom surface to the clamp body top surface, wherein the clamp accumulator bore is shaped to receive a fuel line adapter connection end of the accumulator body inserted into the clamp accumulator bore through the clamp body bottom surface. The accumulator clamp further includes a first bolt bore extending through the clamp body proximate the clamp body first side surface from the clamp body bottom surface to the clamp body top surface, wherein a first bolt bore inner diameter of the first bolt bore is greater than a first mounting bolt outer diameter of a first accumulator mounting bolt extending from the cylinder head adjacent the cylinder head accumulator bore, and a first bolt slot through the clamp body from the first bolt bore to the clamp body front surface, with the first bolt slot extending upwardly from the clamp body bottom surface and having a first bolt slot width that is greater than the first mounting bolt outer diameter. The accumulator clamp also includes a second bolt bore extending through the clamp body proximate the clamp body second side surface from the clamp body bottom surface to the clamp body top surface, wherein a second bolt bore inner diameter of the second bolt bore is greater than a second mounting bolt outer diameter of a second accumulator mounting bolt extending from the cylinder head adjacent the cylinder head accumulator bore, and a second bolt slot through the clamp body from the second bolt bore to the clamp body front surface, with the second bolt slot extending upwardly from the clamp body bottom surface and having a second bolt slot width that is greater than the second mounting bolt outer diameter. The clamp accumulator bore, the first bolt bore and the second bolt bore are positioned so that the first accumulator mounting bolt and the second accumulator mounting bolt can be inserted through the first bolt slot and the second bolt slot and into the first bolt bore and the second bolt bore, respectively, when the injector end of the accumulator body is inserted into the cylinder head accumulator bore.

In a further aspect of the present disclosure, an accumulator assembly for an engine assembly of a machine is disclosed. The engine assembly has a cylinder head with a cylinder head accumulator bore, a first accumulator mounting bolt having a first mounting bolt outer diameter and extending from the cylinder head adjacent the cylinder head accumulator bore, and a second accumulator mounting bolt having a second mounting bolt outer diameter and extending from the cylinder head adjacent the cylinder head accumulator bore. The accumulator assembly includes an accumulator body having a fuel line adapter connection end, an injector end disposed longitudinally opposite the fuel line adapter connection end, and an accumulator body outer surface having a shape that is complimentary to the cylinder head accumulator bore to facilitate insertion of the injector end into the cylinder head accumulator bore, a fuel line adapter, and an accumulator clamp. The accumulator clamp includes a clamp body having a clamp body front surface, a clamp body rear surface, a clamp body bottom surface, a clamp body top surface, a clamp body first side surface and a clamp body second side surface, and a clamp accumulator bore extending through the clamp body from the clamp body bottom surface to the clamp body top surface, wherein the clamp accumulator bore is shaped to receive the fuel line adapter connection end of the accumulator body inserted into the clamp accumulator bore through the clamp body bottom surface. The accumulator clamp further includes a first bolt bore extending through the clamp body proximate the clamp body first side surface from the clamp body bottom surface to the clamp body top surface, wherein a first bolt bore inner diameter of the first bolt bore is greater than the first mounting bolt outer diameter, and a first bolt slot through the clamp body from the first bolt bore to the clamp body front surface, with the first bolt slot extending upwardly from the clamp body bottom surface and having a first bolt slot width that is greater than the first mounting bolt outer diameter. The accumulator clamp also includes a second bolt bore extending through the clamp body proximate the clamp body second side surface from the clamp body bottom surface to the clamp body top surface, wherein a second bolt bore inner diameter of the second bolt bore is greater than the second mounting bolt outer diameter, and a second bolt slot through the clamp body from the second bolt bore to the clamp body front surface, with the second bolt slot extending upwardly from the clamp body bottom surface and having a second bolt slot width that is greater than the second mounting bolt outer diameter. The fuel line adapter connection end of the accumulator body is inserted into the clamp accumulator bore through the clamp body bottom surface and the fuel line adapter is coupled to the fuel line adapter connection end.

Additional aspects are defined by the claims of this patent.

DETAILED DESCRIPTION

Figure 2:
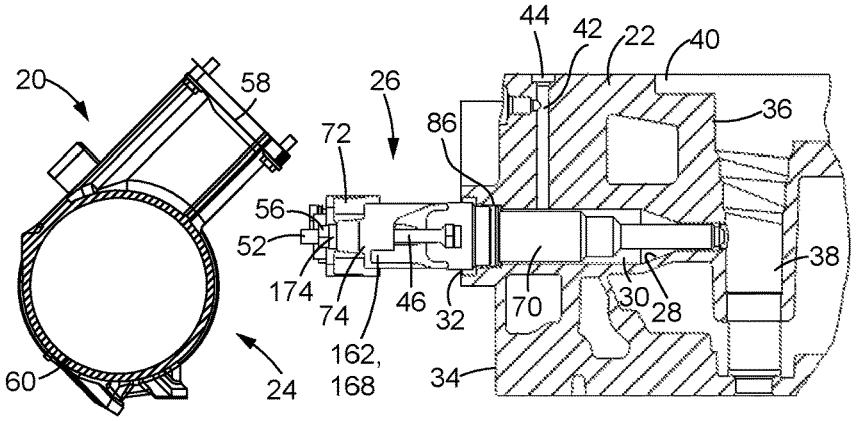
FIG. 2 is a side view of a portion of an engine for a vehicle or machine, including a portion of a cylinder head and an air intake manifold shown in cross-section and an accumulator assembly including an embodiment of an accumulator clamp in accordance with the present disclosure.

Referring to FIG. 2, a portion of an engine assembly 20 for a machine or vehicle is illustrated. The illustrated portion of the engine assembly 20 includes a cylinder head 22 shown in cross-section, an associated air intake manifold 24 mounted adjacent to the cylinder head 22, and an accumulator assembly 26 in accordance with the present disclosure, and. The cylinder head 22 includes a cylinder head accumulator bore surface 28 defining a cylinder head accumulator bore 30 extending inwardly into the cylinder head 22 from an accumulator bore opening 32 in a cylinder head outer surface 34. The cylinder head accumulator bore surface 28 intersects an injector bore surface 36 defining an injector bore 38 extending inwardly into the cylinder head 22 from an injector bore opening 40 in the cylinder head outer surface 34. A fuel injector (not shown) will be installed in the injector bore and have a high pressure fluid inlet port aligned at the intersection of the cylinder head accumulator bore 30 and the injector bore 38. The cylinder head 22 may further include a drain passage 42 connecting a drain port 44 of cylinder head 22 to the cylinder head accumulator bore 30.

Figure 3:
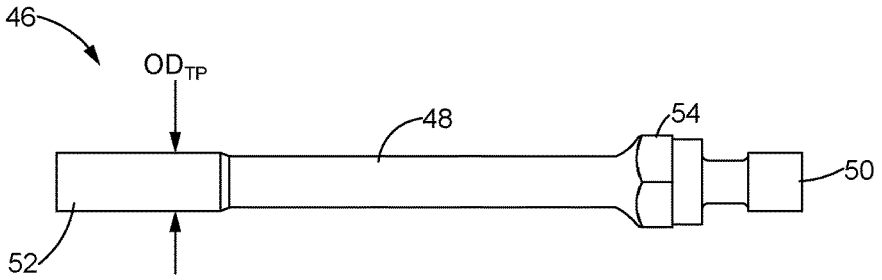
FIG. 3 is a side view of an accumulator mounting bolt.

Although the cylinder head 22 is shown in cross-section, a portion of an accumulator mounting bolt 46 disposed on the viewer's side of the plane cutting the section through the cylinder head 22 is shown for the purpose of fully illustrating and discussing the installation of the accumulator assembly 26 in the cylinder head 22. A second accumulator mounting bolt 46 extends from the cylinder head 22 on the opposite side of the cylinder head accumulator bore 30 and is therefore hidden from view in FIG. 2 by the accumulator assembly 26. The accumulator mounting bolt 46 is illustrated in greater detail in FIG. 3. The accumulator mounting bolt 46 is elongated with a central unthreaded shank 48, a connection portion 50 disposed at one end, and a threaded portion 52 at the end opposite the connection portion 50. The connection portion 50 may be threaded or have other attachment means that may be received and engaged by a corresponding connection bore (not shown) in the cylinder head outer surface 34. The accumulator mounting bolt 46 may further include an engagement portion 54 proximate the connection portion 50 that is configured to be engaged by a tool such as wrench to apply a torque or other force to the accumulator mounting bolt 46 to draft the connection portion 50 into the connection bore to secure the accumulator mounting bolt 46 to the cylinder head 22.

The threaded portion 52 of the accumulator mounting bolt 46 will include outer threads having a thread portion outer diameter $OD_{TP}$. The outer threads of the threaded portion will be received by and mesh with inner threads of a nut 56 (FIG. 2) to secure the accumulator assembly 26 to the cylinder head 22 as discussed further below. In alternative embodiments, the meshing threads may be replaced with other appropriate fastening means that will allow the threaded portion 52 to detachably engage to alternately secure the accumulator assembly 26 to the cylinder head 22 and allow removal of the accumulator assembly 26 as discussed herein.

Returning to FIG. 2, the air intake manifold 24 may include manifold mounting portions 58 and a manifold body 60. One of the manifold mounting portions 58 is attached to a conduit (not shown) placing the air intake manifold 24 in fluid communication with an air intake duct or other fresh air source (not shown). Other manifold mounting portions 58 may be connected to the cylinder head 22 directly or by other air conduits to deliver the fresh air to the engine cylinders (not shown) for the combustion process. The manifold body 60 may be positioned proximate the cylinder head 22 and opposite the accumulator bore opening 32. Additional or alternative components of the engine assembly 20 may be mounted in proximity to the accumulator bore opening 32. As illustrated, the manifold body 60 would prevent the accumulator assembly 26 from being inserted straight into or withdrawn straight from the cylinder head accumulator bore 30.

Figure 4:
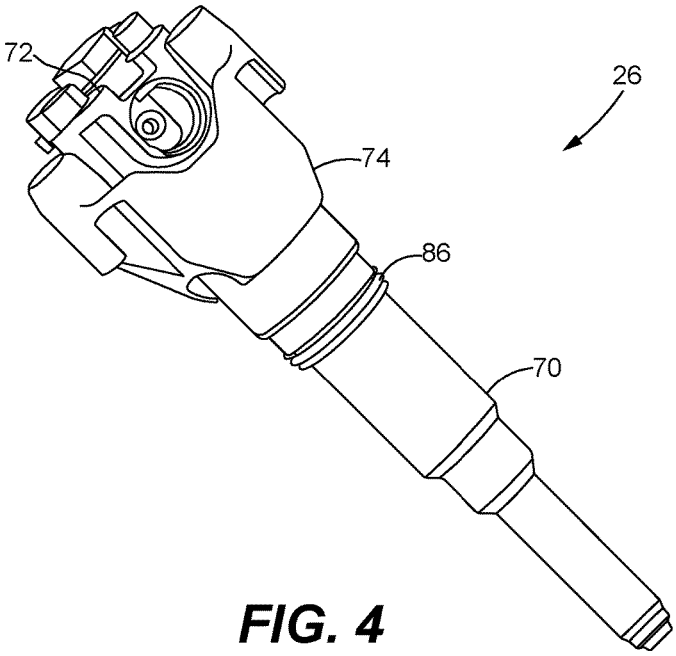
FIG. 4 is an enlarged isometric view of an embodiment of the accumulator assembly in accordance with the present disclosure of the engine of FIG. 2.
Figure 5:
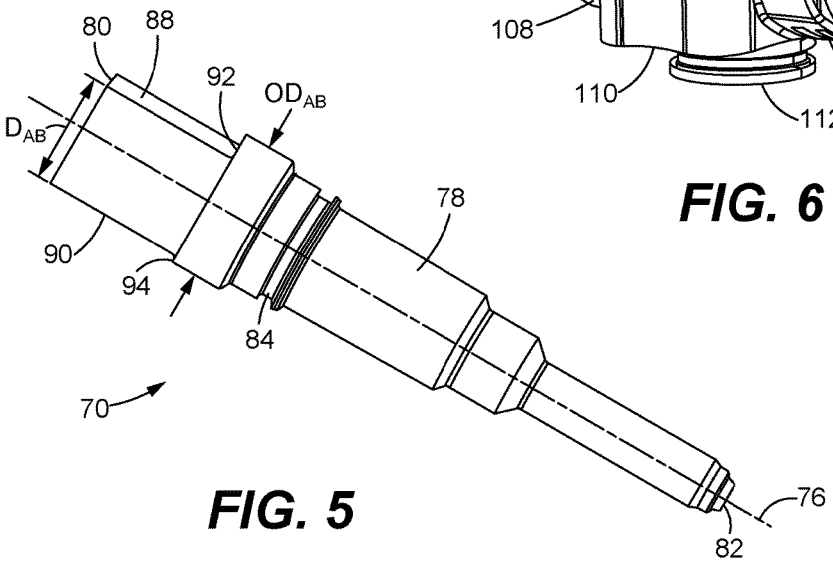
FIG. 5 is an isometric view of an embodiment of an accumulator body of the accumulator assembly of FIG. 4.

As shown in FIG. 4, the accumulator assembly 26 is comprised of multiple components, including an accumulator body 70, a fuel line adapter 72 and an accumulator clamp 74. The accumulator body 70 is illustrated separately from the accumulator assembly 26 in FIG. 5. The accumulator body 70 is generally cylindrical with an accumulator body longitudinal axis 76, and has an accumulator body outer surface 78. The accumulator body outer surface 78 has an accumulator body outer diameter $OD_{AB}$ that may vary along the length of the accumulator body 70. The accumulator body outer diameter $OD_{AB}$ may have an accumulator body maximum outer diameter proximate a fuel line adapter connection end 80, and may taper in increments down to an accumulator body minimum outer diameter proximate an injector end 82 of the accumulator body 70.

As shown in FIG. 2, the accumulator body outer surface 78 has a shape that is complimentary to the cylinder head accumulator bore 30 to facilitate insertion of the injector end 82 into the cylinder head accumulator bore 30. When the accumulator body 70 is installed within the cylinder head accumulator bore 30, a space may exist between the accumulator body outer surface 78 and the cylinder head accumulator bore 30 to allow cooling fluid, such as draining low pressure fuel, to flow over the accumulator body 70 and out of the cylinder head 22 through the drain passage 42. The accumulator body outer surface 78 may include an annular seal groove 84 (FIG. 5) that receives an o-ring seal 86 (FIG. 2) disposed on the accumulator body outer surface 78. When the accumulator body 70 is installed, the o-ring seal 86 engages the cylinder head accumulator bore surface 28 to form a seal there between to prevent leakage of the cooling fluid out of the cylinder head 22 through the accumulator bore opening 32.

Returning to FIG. 5, the accumulator body 70 may be configured for assembly with the fuel line adapter 72 and the accumulator clamp 74 proximate the fuel line adapter connection end 80. The accumulator body outer surface 78 may define a first accumulator body planar surface 88 and a second accumulator body planar surface 90 that are disposed on diametrically opposite sides of the accumulator body 70 and are parallel to each other and to the accumulator body longitudinal axis 76. An accumulator body planar surface distance $D_{AB}$ between the accumulator body planar surfaces 88, 90 will be less than the accumulator body maximum outer diameter that separates the remaining curved portions of the accumulator body outer surface 78 proximate the fuel line adapter connection end 80. The first accumulator body planar surface 88 terminates at a first accumulator body shoulder 92 and the second accumulator body planar surface 90 terminates at a second accumulator body shoulder 94 where the accumulator body outer surface 78 transitions back to a circular cross-section with the accumulator body maximum outer diameter.

Figure 6:
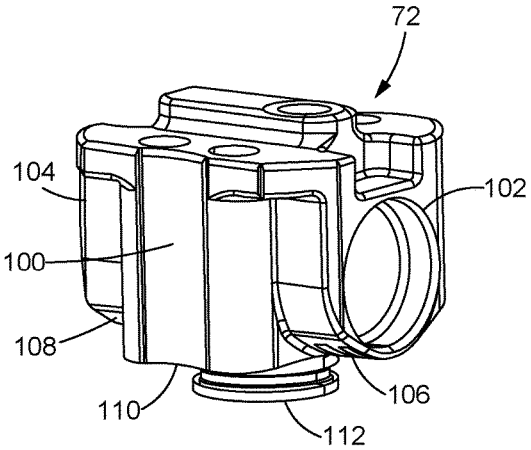
FIG. 6 is an isometric view of an embodiment of a fuel line adapter of the accumulator assembly of FIG. 4.

The fuel line adapter 72 is shown in greater detail in FIG. 6. The fuel line adapter 72 has an adapter body 100 with a first fuel line connector 102 extending from one side of the adapter body 100, and a second fuel line connector 104 extending from the opposite side of the adapter body. The fuel line connectors 102, 104 are configured to connect to fuel lines (not shown) providing pressurized fuel from the common rail (not shown). The fuel line connectors 102, 104 define a first fuel line adapter shoulder 106 and a second fuel line adapter shoulder 108, respectively, that will face corresponding surfaces of the accumulator clamp 74 when the accumulator assembly 26 is assembled as discussed below. When the accumulator assembly 26 is assembled as shown in FIG. 4, the fuel line adapter shoulders 106, 108 will prevent the accumulator clamp 74 from sliding off the fuel line adapter connection end 80 of the accumulator body 70. An accumulator body connection end 110 of the adapter body 100 is configured to engage the fuel line adapter connection end 80 of the accumulator body 70 so that the fuel line adapter 72 places the common rail in fluid communication with the interior of the accumulator body 70. An accumulator body connection cylinder 112 may extend downwardly from the accumulator body connection end 110 and be received by a corresponding fuel line adapter connection opening (not shown) in the fuel line adapter connection end 80 to further establish the fluid connection between the elements. Additional fluid flow control components (not shown) are provided within the accumulator body 70 and/or the fuel line adapter 72 to regulate the flow of fuel through the accumulator assembly 26.

FIGS. 7-12 illustrate an embodiment of the accumulator clamp 74. In the illustrated embodiment, the accumulator clamp 74 has a clamp body 120 with a clamp body front surface 122, a clamp body rear surface 124, a clamp body bottom surface 126, a clamp body top surface 128, a clamp body first side surface 130 and a clamp body second side surface 132. As will be apparent from FIGS. 7-12, the various clamp body surfaces 122-132 are not necessarily planar, and may be contoured as necessary to provide the required functionality and strength discussed herein.

Figure 7:
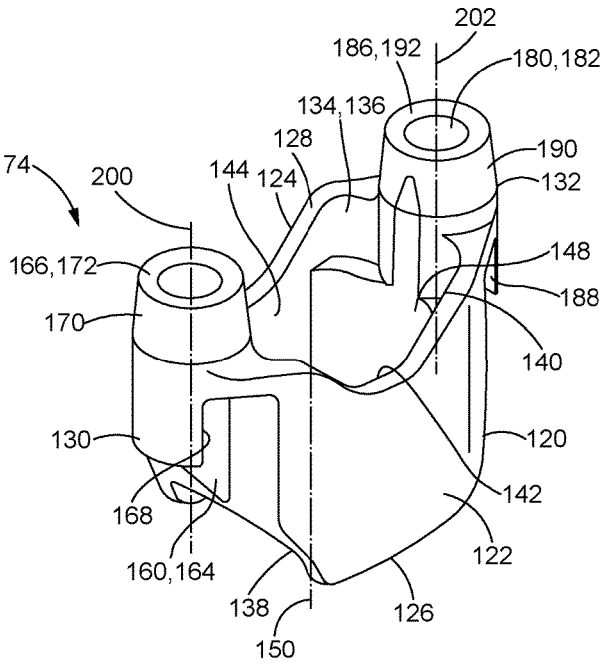
FIG. 7 is an isometric view of an embodiment of the accumulator clamp in accordance with the present disclosure of the accumulator assembly of FIG. 4.
Figure 8:
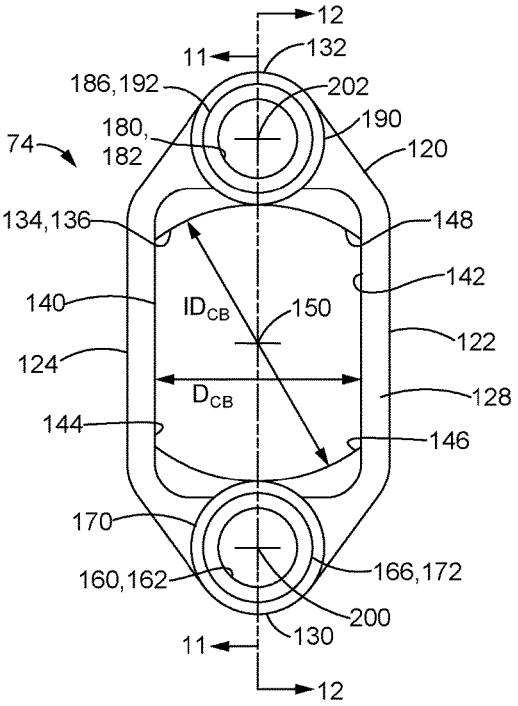
FIG. 8 is a top view of the accumulator clamp of FIG. 7.
Figure 9:
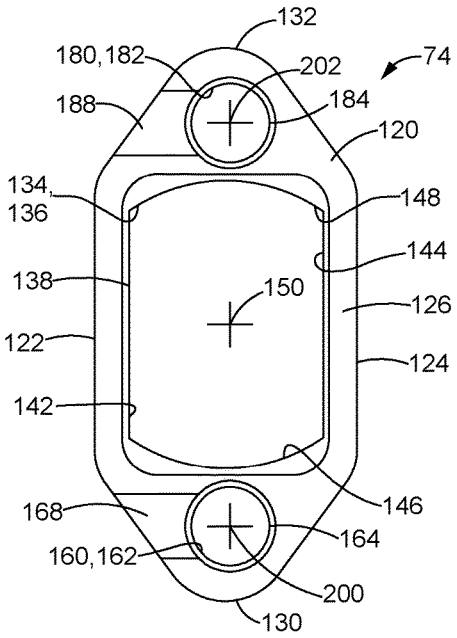
FIG. 9 is a bottom view of the accumulator clamp of FIG. 7.
Figure 10:
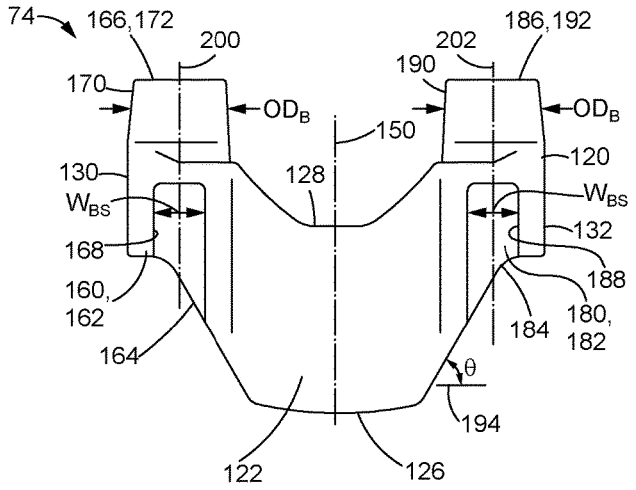
FIG. 10 is a front view of the accumulator clamp of FIG. 7.
Figure 11:
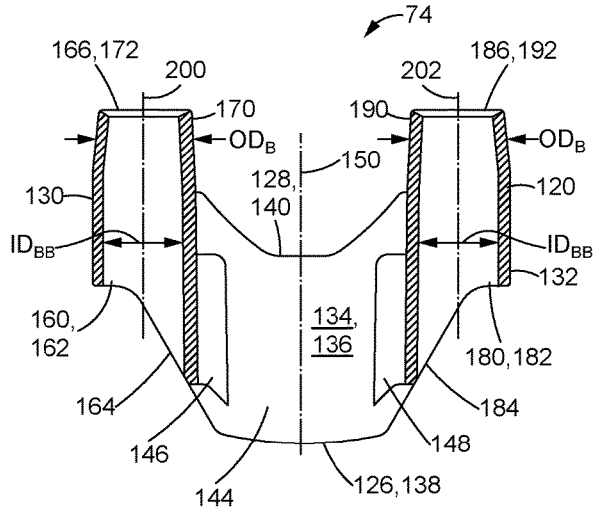
FIG. 11 is a cross-sectional view of the accumulator clamp of FIG. 7 taken through a line 11-11 of FIG. 8.

Referring to FIG. 7, the top view of the accumulator clamp 74 in FIG. 8 and the bottom view of the accumulator clamp 74 in FIG. 9, the clamp body 120 further includes a clamp accumulator bore surface 134 defining a clamp accumulator bore 136 extending through the clamp body 120 from a clamp accumulator bore bottom opening 138 in the clamp body bottom surface 126 to a clamp accumulator bore top opening 140 in the clamp body top surface 128. The clamp accumulator bore 136 is shaped to receive the fuel line adapter connection end 80 of the accumulator body 70 inserted through the clamp accumulator bore bottom opening 138 and through the clamp accumulator bore 136. The clamp accumulator bore surface 134 as shown includes a front planar surface portion 142 proximate the clamp body front surface 122, a rear planar surface portion 144 proximate the clamp body rear surface 124, a first side curved surface portion 146 proximate the clamp body first side surface 130 and a second side curved surface portion 148 proximate the clamp body second side surface 132.

The front planar surface portion 142 and the rear planar surface portion 144 may be approximately parallel to each other and space apart by a clamp body planar surface distance $D_{CB}$ that is greater than the accumulator body planar surface distance $D_{AB}$ separating the accumulator body planar surfaces 88, 90, and less than the accumulator body maximum outer diameter $OD_{AB}$ at the fuel line adapter connection end 80. The side curved surface portions 146, 148 may be semi-cylindrical arcs centered on a clamp accumulator bore longitudinal axis 150 with diametrically opposite points being separated by a clamp accumulator bore inner diameter $ID_{CB}$ that is greater than the accumulator body maximum outer diameter $OD_{AB}$.

With this arrangement, the fuel line adapter connection end 80 may be inserted into the clamp accumulator bore bottom opening 138 when the accumulator body planar surfaces 88, 90 are oriented approximately parallel to the planar surface portions 142, 144 of the clamp accumulator bore 136. The accumulator body 70 may pass through the clamp accumulator bore 136 until the accumulator body shoulders 92, 94 are engaged by the clamp body bottom surface 126. After the fuel line adapter connection end 80 is inserted into the clamp accumulator bore 136, the accumulator body connection cylinder 112 may be inserted into the corresponding opening in the fuel line adapter connection end 80 until the accumulator body connection end 110 of the fuel line adapter 72 engages the fuel line adapter connection end 80, after which an appropriate fastening mechanism, such as bolts or screws, can be used to secure the fuel line adapter 72 to the accumulator body 70. When the accumulator body 70 and the fuel line adapter 72 are secured to each other, the fuel line adapter shoulders 106, 108 face and engage the clamp body top surface 128 to retain the accumulator clamp 74 on the accumulator assembly 26. Moreover, the planar surface portions 142, 144 face and engage the corresponding accumulator body planar surfaces 88, 90 to substantially prevent the accumulator body 70 from rotating about the accumulator body longitudinal axis 76 relative to the accumulator clamp 74.

The accumulator clamp 74 in accordance with the present disclosure is further configured to receive the accumulator mounting bolts 46 of the cylinder head 22 when the accumulator assembly 26 is installed. Referring to the front view of the accumulator clamp 74 shown in FIG. 10 and the cross-sectional views of FIGS. 11 and 12, a first bolt bore surface 160 defines a first bolt bore 162 extending through the clamp body 120 proximate the clamp body first side surface 130 from a first bolt bore bottom opening 164 in the clamp body bottom surface 126 to a first bolt bore top opening 166 in the clamp body top surface 128. The first bolt bore 162 is shaped to receive the threaded portion 52 of one of the accumulator mounting bolts 46 extending from the cylinder head 22 adjacent the cylinder head accumulator bore 30. A bolt bore inner diameter $ID_{BB}$ of the first bolt bore 162 is greater than the thread portion outer diameter $OD_{TP}$ of the threaded portion 52 so that the threaded portion 52 may be inserted through the first bolt bore bottom opening 164 and out of the first bolt bore top opening 166. As best viewed in the cross-sections of FIGS. 11 and 12, the bolt bore inner diameter $ID_{BB}$ tapers from a bolt bore maximum inner diameter proximate the first bolt bore bottom opening 164 to a bolt bore minimum inner diameter proximate the first bolt bore top opening 166.

Figure 12:
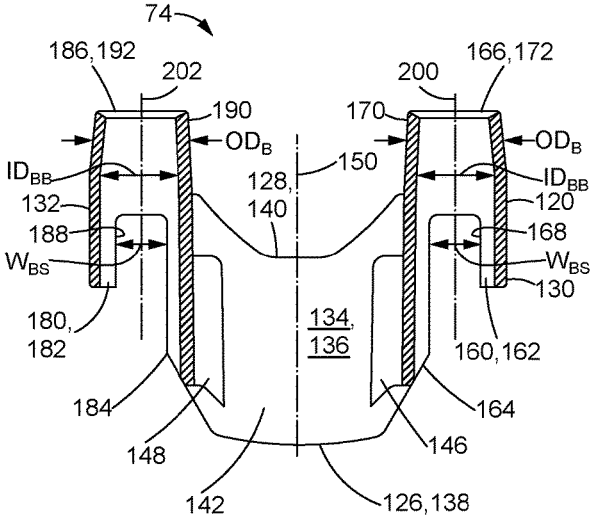
FIG. 12 is a cross-sectional view of the accumulator clamp of FIG. 7 taken through a line 12-12 of FIG. 8.

To facilitate installation and removal of the accumulator assembly 26 in the engine assembly 20 without the necessity of removing the air intake manifold 24, the first bolt bore surface 160 further defines a first bolt slot 168 through the clamp body 120 from the first bolt bore 162 to the clamp body front surface 122. The first bolt slot 168 extends upwardly from the clamp accumulator bore bottom opening 138 in the clamp body bottom surface 126 toward the clamp body top surface 128. The first bolt slot 168 terminates before the first bolt slot 168 extends through the clamp body top surface 128 and the clamp accumulator bore top opening 140. The first bolt slot 168 has a bolt slot width $W_{BS}$ that is greater than the thread portion outer diameter $OD_{TP}$ of the threaded portion 52 of the corresponding accumulator mounting bolt 46 so that the threaded portion 52 of the accumulator mounting bolt 46 is insertable into and removable from the first bolt bore 162 through the first bolt slot 168. As best seen in FIG. 12, the bolt bore inner diameter $ID_{BB}$ may have the bolt bore maximum inner diameter proximate the first bolt slot 168, and the bolt bore maximum inner diameter may be greater than the bolt slot width $W_{BS}$.

Figure 13:
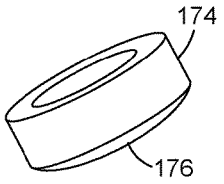
FIG. 13 is an isometric view of a spacer ring having a convex surface.

In order to extend longitudinal length of the first bolt bore 162 and provide additional structural support to compensate for the removal of material from the clamp body 120 to from the first bolt slot 168, the accumulator clamp 74 further includes a first boss 170 extending upwardly from the clamp body top surface 128 at the first bolt bore 162. The first bolt bore surface 160 extends upward through the first boss 170 and terminates at a first boss top surface 172 that defines the first bolt bore top opening 166. The first boss 170 as illustrated has a boss outer diameter $OD_B$ that tapers from a first boss maximum outer diameter proximate the clamp body top surface 128 to a first boss minimum outer diameter proximate the first boss top surface 172. The first boss top surface 172 may be countersunk to form a conical surface so that the first bolt bore top opening 166 can receive and engage a spacer ring 174 (FIG. 13). In one embodiment, the spacer ring 174 may be an annular ring having a convex surface 176. When the accumulator assembly 26 is installed, the spacer ring 174 may slide over the threaded portion 52 of the accumulator mounting bolt 46 with the convex surface 176 facing and engaging the conical surface of the first boss top surface 172 to allow angular misalignment of the accumulator clamp 74 and the accumulator body 70 while maintaining a bearing surface perpendicular to a longitudinal axis of the accumulator mounting bolt 46.

Returning to FIGS. 10-12, the clamp body 120 includes a second bolt bore surface 180 defining a second bolt bore 182 that is substantially similar to the first bolt bore 162 and is configured to receive a second accumulator mounting bolt 46 extending from the cylinder head outer surface 34 on the opposite side of the accumulator bore opening 32 from the first accumulator mounting bolt 46. The second bolt bore 182 extends through the clamp body 120 proximate the clamp body second side surface 132 from a second bolt bore bottom opening 184 in the clamp body bottom surface 126 to a second bolt bore top opening 186 in the clamp body top surface 128. A second bolt slot 188 extends upwardly from the clamp body bottom surface 126 and through the clamp body 120 from the second bolt bore 182 to the clamp body front surface 122. A second boss 190 extends upwardly from the clamp body top surface 128 at the second bolt bore 182, and the second bolt bore surface 180 extends through the second boss 190 and terminates at a second boss top surface 192. The bolt bore inner diameter $ID_{BB}$, the bolt slot width $W_{BS}$ and the boss outer diameter $OD_B$ may have similar dimensions in the second bolt bore 182 and the second boss 190 as described above for the first bolt bore 162 and the first boss 170.

In the illustrated embodiment, outer portions of the clamp body bottom surface 126 in which the first bolt bore bottom opening 164 and the second bolt bore bottom opening 184 are defined are disposed above a central portion in which the clamp accumulator bore bottom opening 138 is defined, and are closer to the clamp body top surface 128 than the clamp accumulator bore bottom opening 138. The outer portions of the clamp body bottom surface 126 extend upward toward the clamp body top surface 128 as they extend outwardly from the central portion and toward the corresponding clamp body side surfaces 130, 132 at an angle θ (FIG. 10) relative to a line 194 perpendicular to the clamp accumulator bore longitudinal axis 150. The angle θ may have a value within a range from 55° to 65°, and in one embodiment may have a value approximately equal to 60°. By angling the outer portions of the clamp body bottom surface 126 away from the central portion and, corresponding, away from the cylinder head 22 when the accumulator assembly 26 is installed, additional clearance is provide to facilitate installation and removal of the accumulator assembly 26 as discussed below.

The clamp accumulator bore 136, the first bolt bore 162 and the second bolt bore 182 may be positioned so that the accumulator mounting bolts 46 can be inserted through the first bolt slot 168 and the second bolt slot 188 and into the first bolt bore 162 and the second bolt bore 182, respectively, when the injector end 82 of the accumulator body 70 is inserted into the cylinder head accumulator bore 30. As shown in FIGS. 8-12, the first bolt bore 162 may have a first bolt bore longitudinal axis 200 and the second bolt bore 182 may have a second bolt bore longitudinal axis 202. The bolt bore longitudinal axes 200, 202 are approximately parallel to the clamp accumulator bore longitudinal axis 150. In the illustrated embodiment, the longitudinal axes 150, 200, 202 are also substantially linearly aligned as shown in FIGS. 8 and 9 to correspond to a linear alignment of the accumulator bore opening 32 and the accumulator mounting bolts 46. However, it is contemplated that the accumulator bore opening 32 and the accumulator mounting bolts 46 may not be linearly aligned in particular configurations of the engine assembly 20. In such cases, the bolt bore longitudinal axes 200, 202 and, correspondingly, the bolt bores 162, 182 and bosses 170, 190 may be offset toward the clamp body front surface 122 or the clamp body rear surface 124 as necessary to align with the accumulator mounting bolts 46.

INDUSTRIAL APPLICABILITY

Figure 1:
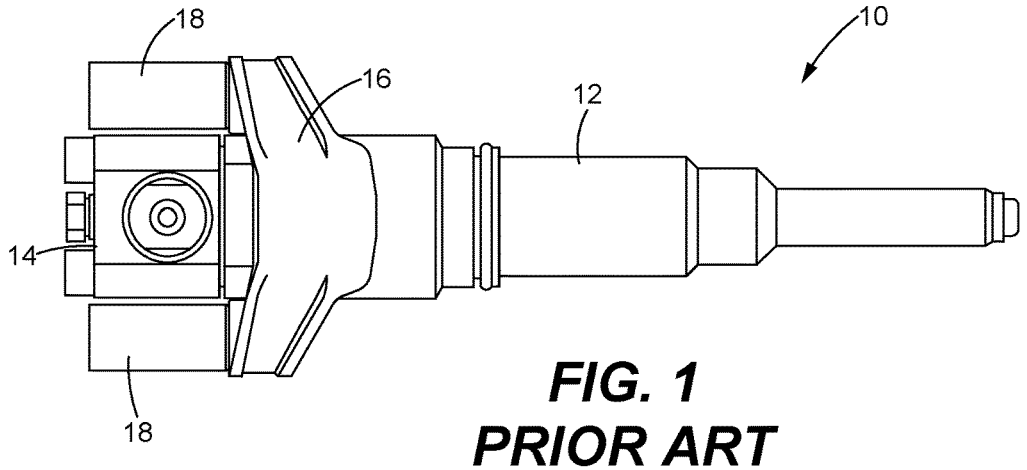
FIG. 1 PRIOR ART
FIG. 1 is a side view of an accumulator assembly including an accumulator clamp previously known in the art.
Figure 14A:
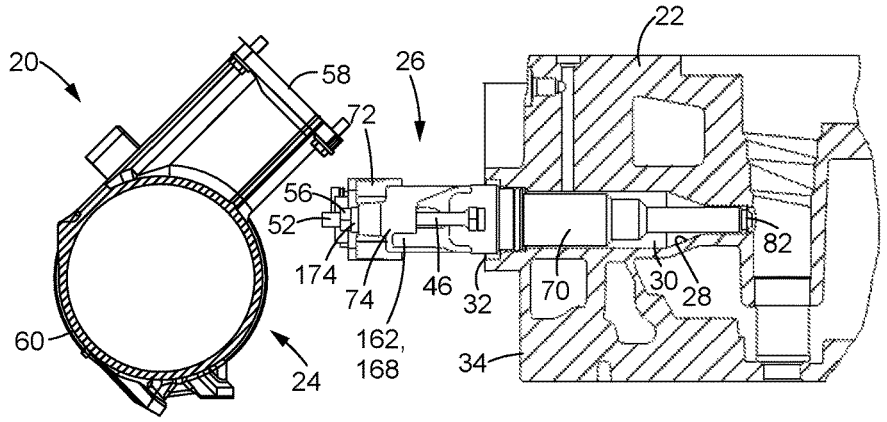
FIGS. 14A-14F are the side view of the portion of the engine for the vehicle or machine of FIG. 2 illustrating a sequence of removing the accumulator assembly from the cylinder head without removing the air intake manifold.
Figure 14B:
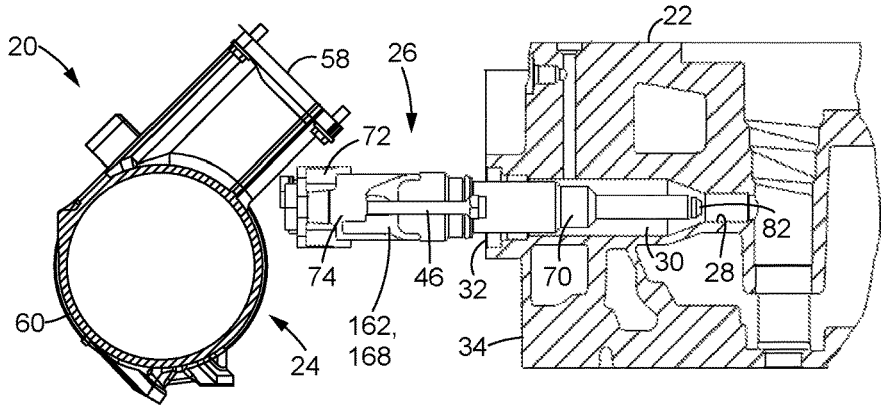

The disassembly of the accumulator assembly 26 from the cylinder head accumulator bore 30 of the cylinder head 22 is illustrated by the sequence in FIGS. 14A-14F. Referring to FIG. 14A, the portion of the engine assembly 20 shown in FIG. 1 is reproduced. The accumulator assembly 26 is installed with the injector end 82 of the accumulator body 70 disposed within the cylinder head accumulator bore 30, and with nuts 56 and spacer rings 174 disposed on the threaded portions 52 of the accumulator mounting bolts 46 and tightened down to retain the accumulator assembly 26 in the installed position. When it is desired to remove the accumulator assembly 26 from the cylinder head 22, the nuts 56 and the spacer rings 174 are removed from the threaded portions 52 of the accumulator mounting bolts 46, and the accumulator assembly 26 can begin to be withdrawn from the cylinder head accumulator bore 30 as shown in FIG. 14B. Initially, the combination of the accumulator body 70 being disposed within the cylinder head accumulator bore 30 and the threaded portions 52 of the accumulator mounting bolts 46 being disposed within the bolt bores 162, 182 restricts the accumulator assembly 26 to movement substantially parallel to the accumulator body longitudinal axis 76 with minimal rotation of the accumulator assembly 26.

Figure 14C:
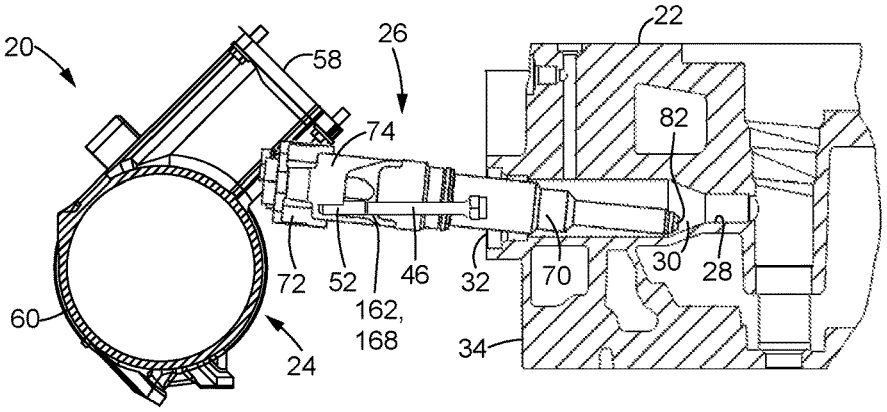

FIG. 14C illustrates the accumulator assembly 26 at the position where the accumulator assembly 26 has been withdrawn from the cylinder head accumulator bore 30 far enough that the threaded portions 52 of the accumulator mounting bolts 46 are aligned with the bolt slots 168, 188 of the bolt bores 162, 182. Because the bolt slot width $W_{BS}$ is greater than thread portion outer diameter $OD_{TP}$, the accumulator assembly 26 may be rotated upwardly in the clockwise direction as shown in FIG. 14C so that the threaded portions 52 of the accumulator mounting bolts 46 pass through the bolt slots 168, 188. The rotation of the accumulator assembly 26 is still limited by engagement between the injector end 82 and other portions of the accumulator body outer surface 78 with the cylinder head accumulator bore surface 28.

Figure 14D:
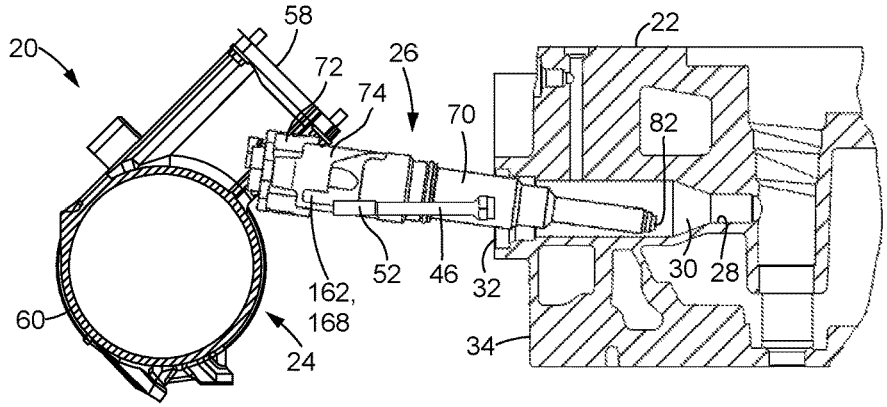
Figure 14E:
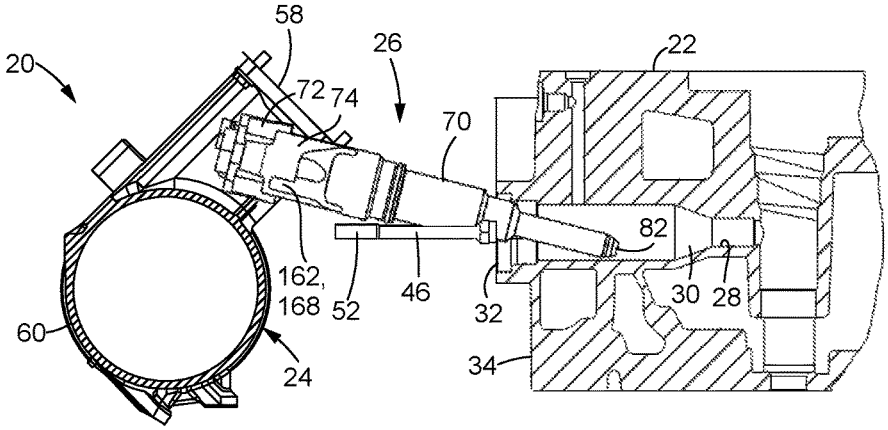
Figure 14F:
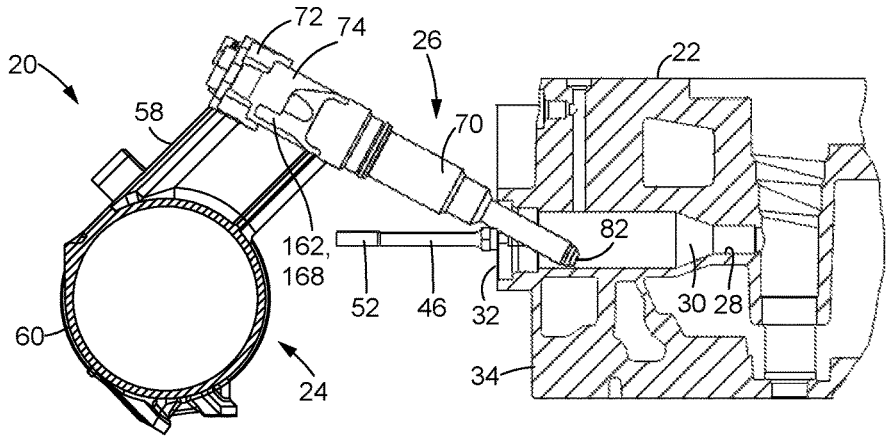

Turning to FIG. 14D, the accumulator assembly 26 is further withdrawn from the cylinder head accumulator bore 30. As shown, the fuel line adapter 72 and the accumulator clamp 74 are close to the manifold body 60 of the air intake manifold 24. The accumulator assembly 26 would be engaging the air intake manifold 24 and thereby prevented from being removed from the cylinder head accumulator bore 30 if the accumulator assembly 26 had been pulled out of the cylinder head accumulator bore 30 parallel to the accumulator body longitudinal axis 76. However, because the threaded portions 52 of the accumulator mounting bolts 46 can pass through the bolt slots 168, 188, the fuel line adapter 72 and the accumulator clamp 74 have been rotated away from the manifold body 60. The further the accumulator assembly 26 is pulled out of the cylinder head accumulator bore 30, the more the accumulator assembly 26 can be rotated in the clockwise direction away from the manifold body 60 as shown in FIG. 14E. Eventually, when the accumulator assembly 26 is pulled out of the cylinder head accumulator bore 30 and rotated to the position shown in FIG. 14F, the accumulator assembly 26 is clear of the manifold body 60 and can be completely separated from the cylinder head accumulator bore 30. A repaired or replacement accumulator assembly 26 may be reinstalled in the cylinder head accumulator bore 30 without removing the air intake manifold 24 by reversing the process illustrated in FIGS. 14A-14F and inserting the injector end 82 of the accumulator body 70 and rotating the accumulator assembly 26 in the counterclockwise direction without engaging the manifold body 60. Eventually, the threaded portions 52 of the accumulator mounting bolts 46 can pass through the bolt slots 168, 188 and into the bolt bores 162, 182 so the accumulator body 70 can be fully inserted into the cylinder head accumulator bore 30.

The accumulator assembly 26 in accordance with the present disclosure may facilitate a reduction in the time and effort required to perform maintenance on the engine assembly 20. Previous accumulator assemblies required removal of air intake manifolds and other components of the engine assembly due to the space limitations within the engine compartment. Without the necessity of removing engine components that do not require repair or replacement, service personnel can devote their time and effort to the components requiring maintenance. The reduction in maintenance time translates into a reduction in the amount of time that the machine or vehicle is out of service and unavailable to the owner for performing work at a worksite.

While the preceding text sets forth a detailed description of numerous different embodiments, it should be understood that the legal scope of protection is defined by the words of the claims set forth at the end of this patent. The detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims defining the scope of protection.

It should also be understood that, unless a term was expressly defined herein, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to herein in a manner consistent with a single meaning, that is done for sake of clarity only so as to not confuse the reader, and it is not intended that such claim term be limited, by implication or otherwise, to that single meaning.

What is claimed is:

1. An accumulator clamp for an accumulator assembly in an engine assembly of a machine, where the accumulator assembly further includes an accumulator body and a fuel line adapter connected thereto, and the accumulator assembly is mountable to a cylinder head of the engine assembly with an injector end of the accumulator body disposed within a cylinder head accumulator bore of the cylinder head, the accumulator clamp comprising:

a clamp body having a clamp body front surface, a clamp body rear surface, a clamp body bottom surface, a clamp body top surface, a clamp body first side surface and a clamp body second side surface;

a clamp accumulator bore surface defining a clamp accumulator bore extending through the clamp body from a clamp accumulator bore bottom opening in the clamp body bottom surface to a clamp accumulator bore top opening in the clamp body top surface, wherein the clamp accumulator bore is shaped to receive a fuel line adapter connection end of the accumulator body inserted through the clamp accumulator bore bottom opening and through the clamp accumulator bore;

a first bolt bore surface defining a first bolt bore extending through the clamp body proximate the clamp body first side surface from a first bolt bore bottom opening in the clamp body bottom surface to a first bolt bore top opening in the clamp body top surface, wherein the first bolt bore is shaped to receive a first threaded portion of a first accumulator mounting bolt extending from the cylinder head adjacent the cylinder head accumulator bore, wherein a first bolt bore inner diameter of the first bolt bore is greater than a first thread portion outer diameter of the first threaded portion of the first accumulator mounting bolt, wherein the first bolt bore surface further defines a first bolt slot through the clamp body from the first bolt bore surface to the clamp body front surface, with the first bolt slot extending upwardly from the clamp body bottom surface and terminating before the first bolt slot extends through the clamp body top surface and with the first bolt slot having a first bolt slot width that is greater than the first thread portion outer diameter of the first threaded portion so that the first threaded portion of the first accumulator mounting bolt is insertable into and removable from the first bolt bore through the first bolt slot; and a second bolt bore surface defining a second bolt bore extending through the clamp body proximate the clamp body second side surface from a second bolt bore bottom opening in the clamp body bottom surface to a second bolt bore top opening in the clamp body top surface, wherein the second bolt bore is shaped to receive a second threaded portion of a second accumulator mounting bolt extending from the cylinder head adjacent the cylinder head accumulator bore and diametrically opposite from the first accumulator mounting bolt relative the cylinder head accumulator bore, wherein a second bolt bore inner diameter of the second bolt bore is greater than a second thread portion outer diameter of the second threaded portion of the second accumulator mounting bolt, wherein the second bolt bore surface further defines a second bolt slot through the clamp body from the second bolt bore surface to the clamp body front surface, with the second bolt slot extending upwardly from the clamp body bottom surface and terminating before the second bolt slot extends through the clamp body top surface and with the second bolt slot having a second bolt slot width that is greater than the second thread portion outer diameter of the second threaded portion so that the second threaded portion of the second accumulator mounting bolt is insertable into and removable from the second bolt bore through the second bolt slot.

2. The accumulator clamp of claim 1, wherein the first bolt bore bottom opening and the second bolt bore bottom opening are closer to the clamp body top surface than the clamp accumulator bore bottom opening.

3. The accumulator clamp of claim 1, comprising:

a first boss extending upwardly from the clamp body top surface at the first bolt bore, wherein the first bolt bore surface extends through the first boss and terminates at a first boss top surface; and a second boss extending upwardly from the clamp body top surface at the second bolt bore, wherein the second bolt bore surface extends through the second boss and terminates at a second boss top surface.

4. The accumulator clamp of claim 3, wherein the first boss top surface is countersunk to form a first conical surface to receive and engage a first convex surface of a first spacer ring, and the second boss top surface is countersunk to form a second conical surface to receive and engage a second convex surface of a second spacer ring.

5. The accumulator clamp of claim 3, wherein the first boss tapers from a first boss maximum outer diameter proximate the clamp body top surface to a first boss minimum outer diameter proximate the first boss top surface, and the second boss tapers from a second boss maximum outer diameter proximate the clamp body top surface to a second boss minimum outer diameter proximate the first boss top surface.

6. The accumulator clamp of claim 1, wherein the first bolt bore inner diameter proximate the first bolt slot is greater than the first bolt slot width, and the second bolt bore inner diameter proximate the second bolt slot is greater than the second bolt slot width.

7. The accumulator clamp of claim 1, wherein the first bolt bore inner diameter tapers from a first bolt bore maximum inner diameter proximate the first bolt slot to a first bolt bore minimum inner diameter proximate the first bolt bore top opening, and wherein second bolt bore inner diameter tapers from a second bolt bore maximum inner diameter proximate the second bolt slot to a second bolt bore minimum inner diameter proximate the second bolt bore top opening.

8. An accumulator clamp for an accumulator assembly in an engine assembly of a machine, where the accumulator assembly further includes an accumulator body and a fuel line adapter connected thereto, and the accumulator assembly is mountable to a cylinder head of the engine assembly with an injector end of the accumulator body disposed within a cylinder head accumulator bore of the cylinder head, the accumulator clamp comprising:

a clamp body having a clamp body front surface, a clamp body rear surface, a clamp body bottom surface, a clamp body top surface, a clamp body first side surface and a clamp body second side surface;

a clamp accumulator bore extending through the clamp body from the clamp body bottom surface to the clamp body top surface, wherein the clamp accumulator bore is shaped to receive a fuel line adapter connection end of the accumulator body inserted into the clamp accumulator bore through the clamp body bottom surface;

a first bolt bore extending through the clamp body proximate the clamp body first side surface from the clamp body bottom surface to the clamp body top surface, wherein a first bolt bore inner diameter of the first bolt bore is greater than a first mounting bolt outer diameter of a first accumulator mounting bolt extending from the cylinder head adjacent the cylinder head accumulator bore;

a first bolt slot through the clamp body from the first bolt bore to the clamp body front surface, with the first bolt slot extending upwardly from the clamp body bottom surface and having a first bolt slot width that is greater than the first mounting bolt outer diameter;

a second bolt bore extending through the clamp body proximate the clamp body second side surface from the clamp body bottom surface to the clamp body top surface, wherein a second bolt bore inner diameter of the second bolt bore is greater than a second mounting bolt outer diameter of a second accumulator mounting bolt extending from the cylinder head adjacent the cylinder head accumulator bore; and a second bolt slot through the clamp body from the second bolt bore to the clamp body front surface, with the second bolt slot extending upwardly from the clamp body bottom surface and having a second bolt slot width that is greater than the second mounting bolt outer diameter, and wherein the clamp accumulator bore, the first bolt bore and the second bolt bore are positioned so that the first accumulator mounting bolt and the second accumulator mounting bolt can be inserted through the first bolt slot and the second bolt slot and into the first bolt bore and the second bolt bore, respectively, when the injector end of the accumulator body is inserted into the cylinder head accumulator bore.

9. The accumulator clamp of claim 8, wherein the first bolt bore and the second bolt bore intersect corresponding bolt bore portions of the clamp body bottom surface that are closer to the clamp body top surface than a clamp accumulator bore portion of the clamp body bottom surface intersected by the clamp accumulator bore.

10. The accumulator clamp of claim 8, comprising:

a first boss extending upwardly from the clamp body top surface at the first bolt bore, wherein the first bolt bore extends through the first boss and terminates at a first boss top surface; and a second boss extending upwardly from the clamp body top surface at the second bolt bore, wherein the second bolt bore extends through the second boss and terminates at a second boss top surface.

11. The accumulator clamp of claim 10, wherein the first boss top surface is countersunk to form a first conical surface to receive and engage a first convex surface of a first spacer ring, and the second boss top surface is countersunk to form a second conical surface to receive and engage a second convex surface of a second spacer ring.

12. The accumulator clamp of claim 10, wherein the first boss tapers from a first boss maximum outer diameter proximate the clamp body top surface to a first boss minimum outer diameter proximate the first boss top surface, and the second boss tapers from a second boss maximum outer diameter proximate the clamp body top surface to a second boss minimum outer diameter proximate the second boss top surface.

13. The accumulator clamp of claim 8, wherein the first bolt bore inner diameter proximate the first bolt slot is greater than the first bolt slot width, and the second bolt bore inner diameter proximate the second bolt slot is greater than the second bolt slot width.

14. The accumulator clamp of claim 8, wherein the first bolt bore inner diameter tapers from a first bolt bore maximum inner diameter proximate the first bolt slot to a first bolt bore minimum inner diameter proximate the clamp body top surface, and wherein second bolt bore inner diameter tapers from a second bolt bore maximum inner diameter proximate the second bolt slot to a second bolt bore minimum inner diameter proximate the clamp body top surface.

15. An accumulator assembly for an engine assembly of a machine having a cylinder head with a cylinder head accumulator bore, a first accumulator mounting bolt having a first mounting bolt outer diameter and extending from the cylinder head adjacent the cylinder head accumulator bore, and a second accumulator mounting bolt having a second mounting bolt outer diameter and extending from the cylinder head adjacent the cylinder head accumulator bore, the accumulator assembly comprising:

an accumulator body having a fuel line adapter connection end, an injector end disposed longitudinally opposite the fuel line adapter connection end, and an accumulator body outer surface having a shape that is complimentary to the cylinder head accumulator bore to facilitate insertion of the injector end into the cylinder head accumulator bore;

a fuel line adapter; and an accumulator clamp comprising a clamp body having a clamp body front surface, a clamp body rear surface, a clamp body bottom surface, a clamp body top surface, a clamp body first side surface and a clamp body second side surface, a clamp accumulator bore extending through the clamp body from the clamp body bottom surface to the clamp body top surface, wherein the clamp accumulator bore is shaped to receive the fuel line adapter connection end of the accumulator body inserted into the clamp accumulator bore through the clamp body bottom surface, a first bolt bore extending through the clamp body proximate the clamp body first side surface from the clamp body bottom surface to the clamp body top surface, wherein a first bolt bore inner diameter of the first bolt bore is greater than the first mounting bolt outer diameter, a first bolt slot through the clamp body from the first bolt bore to the clamp body front surface, with the first bolt slot extending upwardly from the clamp body bottom surface and having a first bolt slot width that is greater than the first mounting bolt outer diameter, a second bolt bore extending through the clamp body proximate the clamp body second side surface from the clamp body bottom surface to the clamp body top surface, wherein a second bolt bore inner diameter of the second bolt bore is greater than the second mounting bolt outer diameter, and a second bolt slot through the clamp body from the second bolt bore to the clamp body front surface, with the second bolt slot extending upwardly from the clamp body bottom surface and having a second bolt slot width that is greater than the second mounting bolt outer diameter, wherein the fuel line adapter connection end of the accumulator body is inserted into the clamp accumulator bore through the clamp body bottom surface and the fuel line adapter is coupled to the fuel line adapter connection end.

16. The accumulator assembly of claim 15, wherein the clamp accumulator bore, the first bolt bore and the second bolt bore are positioned so that the first accumulator mounting bolt and the second accumulator mounting bolt can be inserted through the first bolt slot and the second bolt slot and into the first bolt bore and the second bolt bore, respectively, when the injector end of the accumulator body is inserted into the cylinder head accumulator bore.

17. The accumulator assembly of claim 15, wherein the first bolt bore and the second bolt bore intersect corresponding bolt bore portions of the clamp body bottom surface that are closer to the clamp body top surface than a clamp accumulator bore portion of the clamp body bottom surface intersected by the clamp accumulator bore.

18. The accumulator assembly of claim 15, wherein the accumulator clamp comprises:

a first boss extending upwardly from the clamp body top surface at the first bolt bore, wherein the first bolt bore extends through the first boss and terminates at a first boss top surface; and a second boss extending upwardly from the clamp body top surface at the second bolt bore, wherein the second bolt bore extends through the second boss and terminates at a second boss top surface.

19. The accumulator assembly of claim 18, wherein the first boss top surface is countersunk to form a first conical surface and the second boss top surface is countersunk to form a second conical surface, the accumulator assembly comprises:

a first spacer ring having a first spacer ring convex surface that is received and engaged by the first conical surface; and a second spacer ring having a second spacer ring convex surface that is received and engaged by the second conical surface.

20. The accumulator assembly of claim 15, wherein the first bolt bore inner diameter tapers from a first bolt bore maximum inner diameter proximate the first bolt slot to a first bolt bore minimum inner diameter proximate the clamp body top surface, and wherein second bolt bore inner diameter tapers from a second bolt bore maximum inner diameter proximate the second bolt slot to a second bolt bore minimum inner diameter proximate the clamp body top surface.

* * * * *